US008561563B2

(12) United States Patent
Yao et al.

(10) Patent No.: US 8,561,563 B2
(45) Date of Patent: Oct. 22, 2013

(54) SIDE-BY-SIDE MOORING BAY

(75) Inventors: Zong Yao, Singapore (SG); Wen Sin Chong, Singapore (SG); Hee Yan Yip, Singapore (SG); Kok Seng Foo, Singapore (SG)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 243 days.

(21) Appl. No.: 12/998,338

(22) PCT Filed: Oct. 9, 2009

(86) PCT No.: PCT/SG2009/000371

§ 371 (c)(1),
(2), (4) Date: Apr. 8, 2011

(87) PCT Pub. No.: WO2010/042074

PCT Pub. Date: Apr. 15, 2010

(65) Prior Publication Data

US 2012/0285358 A1 Nov. 15, 2012

Related U.S. Application Data

(60) Provisional application No. 61/104,059, filed on Oct. 9, 2008.

(51) Int. Cl.
*B63B 22/02* (2006.01)

(52) U.S. Cl.
USPC ..... 114/230.13; 114/230.15; 114/256; 441/5

(58) Field of Classification Search
USPC ..... 114/230.12, 230.13, 230.15, 230.2, 114/256; 441/3, 4, 5
See application file for complete search history.

(56) References Cited

U.S. PATENT DOCUMENTS 4,290,158 A * 9/1981 Kuntz, Jr. ..... 441/3
6,854,408 B2 2/2005 De Baan (Continued)

FOREIGN PATENT DOCUMENTS

EP 1 705 112 A1 9/2006
EP 1 826 116 A1 8/2007

(Continued)

OTHER PUBLICATIONS

Supplementary European Search Report from EP App. No. 09 819 526.6 dated Mar. 1, 2012.

(Continued)

*Primary Examiner* — Lars A Olson
(74) *Attorney, Agent, or Firm* — Arent Fox LLP

(57) ABSTRACT

A mooring system may comprise a station keeping apparatus having a turntable rotatably mounted thereon. The station keeping apparatus is operable to movably couple to a first vessel and to a second vessel in a side-by-side configuration. The turntable is operable to freely rotate both the first and the second vessel about the station keeping apparatus. The station keeping apparatus is securable to the second vessel using a head mooring line having a length which is adjustable for aligning a heading of both the first and the second vessel with a prevailing weather direction. Further, the mooring system may comprise a rigid yoke or a soft yoke movably coupling the turntable to the first vessel for angular adjustment between the station keeping apparatus and a longitudinal center line of the first vessel.

20 Claims, 9 Drawing Sheets

(56) References Cited

U.S. PATENT DOCUMENTS

| | | | |
|---|---|---|---|
| 7,308,863 | B2 | 12/2007 | De Baan |
| 2005/0145154 | A1 | 7/2005 | De Baan |
| 2005/0193938 | A1 | 9/2005 | Boatman et al. |
| 2007/0289517 | A1 | 12/2007 | Poldervaart et al. |

FOREIGN PATENT DOCUMENTS

| | | | |
|---|---|---|---|
| GB | 1 055 129 | A | 1/1967 |
| GB | 1055129 | | 1/1967 |
| JP | 58-97584 | A | 6/1983 |
| JP | 58-202183 | A | 11/1983 |
| WO | WO 2006/101395 | A1 | 9/2006 |

OTHER PUBLICATIONS

"Offloading Mooring Configurations" Moorings OE6664, Single Point, CALM (Catenary Anchor Leg Mooring) buoy offloading, TUDelft.

* cited by examiner

SIDE-BY-SIDE MOORING BAY

CROSS-REFERENCE TO RELATED APPLICATION

This application is a National Stage entry of International Application No. PCT/SG2009/000371, having an international filing date of Oct. 9, 2009, which claims priority to U.S. Provisional Application No. 61/104,059, filed Oct. 9, 2008, the disclosure of each of which is hereby incorporated in its entirety by reference.

BACKGROUND

1. Technical Field

Embodiments of the invention relate generally to systems and methods for side-by-side mooring of vessels at an offshore location to minimize relative motions between the vessels and reduce undesirable forces induced by weather conditions.

2. Description of Related Art

Offshore mooring systems have been used to secure two vessels in a side-by-side configuration. In a side-by-side mooring configuration, the vessels respond to changes in environmental conditions as a single vessel. One common problem is the dynamic directional changes in environmental conditions, e.g. wind, wave and/or current, which will increase relative motions between the vessels and mooring forces acting on the fenders and mooring lines between the vessels. In order to minimise relative motions between the vessels and mooring forces acting on the fenders and mooring lines between the vessels, it would be desirable to allow the vessels weather vane such that the heading of the moored configuration is aligned to the prevailing weather condition. This alignment minimises the vessel area exposed to wind, wave and currents which, in turn, minimizes the load on the mooring.

U.S. Patent Application Publication No. US 2007/0289517 A1 (Poldervaart et al.) (hereinafter '517) relates to a mooring system with a first vessel for containing hydrocarbons having at its bow and/or stem a transverse arm and a fluid transfer mechanism of a duct connected to a tank on the first vessel and a coupling end for connecting to a second vessel. The second vessel is moored alongside the first vessel and is attached via at least one cable, extending from its bow in the length direction of the vessel, to a mooring end of the arm. The mooring end of the arm is situated at or near a longitudinal centerline of the second vessel. The arm, during use, is in a fixed position and a pulling force element is attached to the cable for applying a pulling force on the cable upon relative movement of the second vessel with respect to the arm. The force element allows a predetermined maximum displacement of the second vessel.

However, the mooring system of '517 suffers from a number of problems. For example, the mooring system of '517 would not allow complete alignment of the moored configuration to the dominant environmental condition. Further, as the mooring arm of '517 is rigid and is subject to forces induced by vessel motions in six degrees-of-freedom, i.e. surge, sway, pitch, roll, heave and yaw, the mooring arm is prone to damage and breakage.

Accordingly, a mooring system that eliminates the above and other problems of existing mooring systems is highly desired.

SUMMARY

Embodiments of the invention provide systems and methods for side-by-side mooring of two vessels which would overcome the above and other problems. Embodiments of the invention provide side-by-side mooring configurations which are capable of aligning and re-aligning a heading of the mooring configuration with a prevailing weather direction. Re-aligning the heading of the mooring configuration may be required in situations including, but not limited to, changes in relative displacement of the moored vessels and/or prevailing weather direction.

According to one embodiment of the invention, a mooring system comprises a station keeping apparatus which, in turn, includes a turntable rotatably mounted thereon. In a mooring configuration, the station keeping apparatus is operable to movably couple to a first vessel and to a second vessel for providing a side-by-side mooring configuration. Further, the turntable is operable to freely rotate both the first vessel and the second vessel about the station keeping apparatus. Further, the station keeping apparatus is securable to the second vessel using a head mooring line having a length which is adjustable for aligning a heading of both the first vessel and the second vessel with a prevailing weather direction. Yet further, the mooring system may comprise a yoke movably coupling the turntable to the first vessel for providing adjustable angular displacement between the station keeping apparatus and a longitudinal centre line of the first vessel and providing a weather-vaning mooring point when the first vessel is single-point moored.

According to one embodiment for deep water applications, the station keeping apparatus comprises a buoy upon which the turntable is mounted, and the buoy is attached to a sea bed by anchor legs. Further, a rigid yoke is used to movably couple the mooring system with the first vessel.

According to another embodiment for shallow water applications, the station keeping apparatus includes a fixed structure founded on a sea bed, and a turntable rotatably mounted on the fixed structure. Further, a soft yoke, which includes ball joint, universal joints, hanging beams, counterweights and soft yoke arm, is used to movably couple the mooring system to the first vessel.

Further, the first vessel and the second vessel may be moored at a bow or a stern of each respective vessel.

BRIEF DESCRIPTION OF THE DRAWINGS

Embodiments of the invention are disclosed hereinafter with reference to the drawings, in which.

DETAILED DESCRIPTION

Figure 1A:
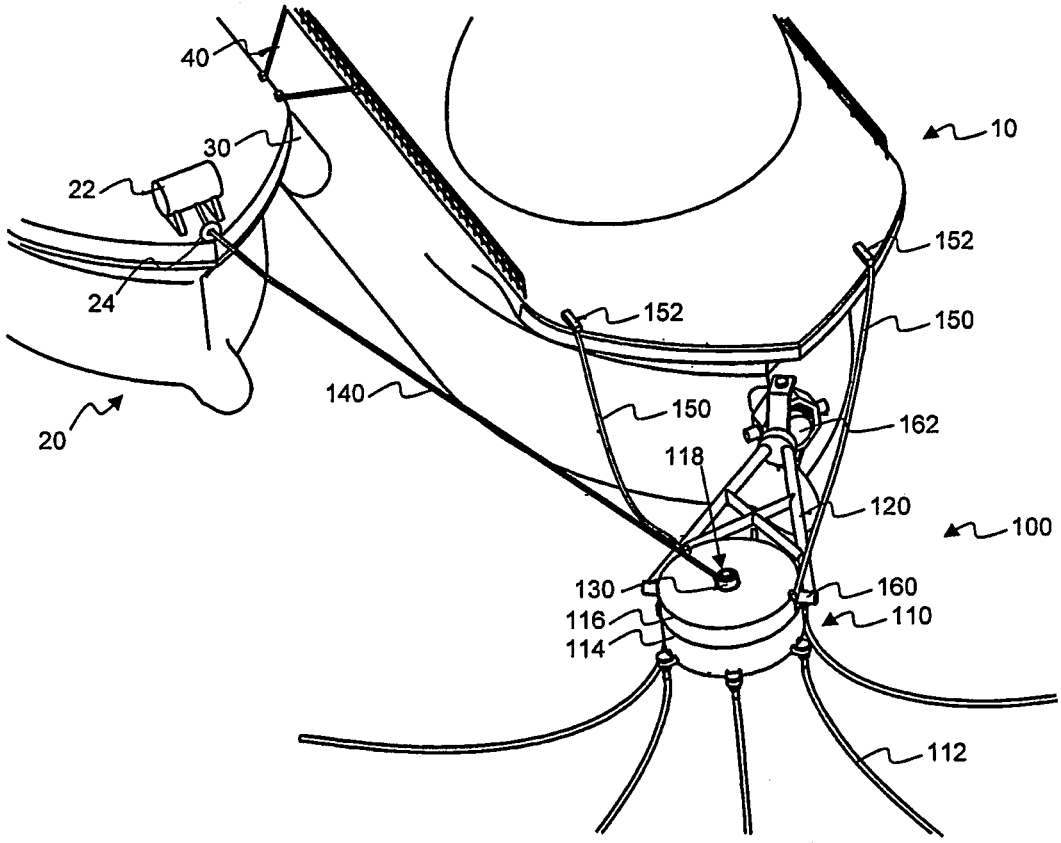
FIGS. 1A and 1B illustrate a mooring system in a mooring configuration according to one embodiment of the invention.

In the following description, numerous specific details are set forth in order to provide a thorough understanding of various illustrative embodiments of the invention. It will be understood, however, to one skilled in the art, that embodiments of the invention may be practiced without some or all of these specific details. In other instances, well known process operations have not been described in detail in order not to unnecessarily obscure pertinent aspects of embodiments being described. In the drawings, like reference numerals refer to same or similar functionalities or features throughout the several views.

Figure 1B:
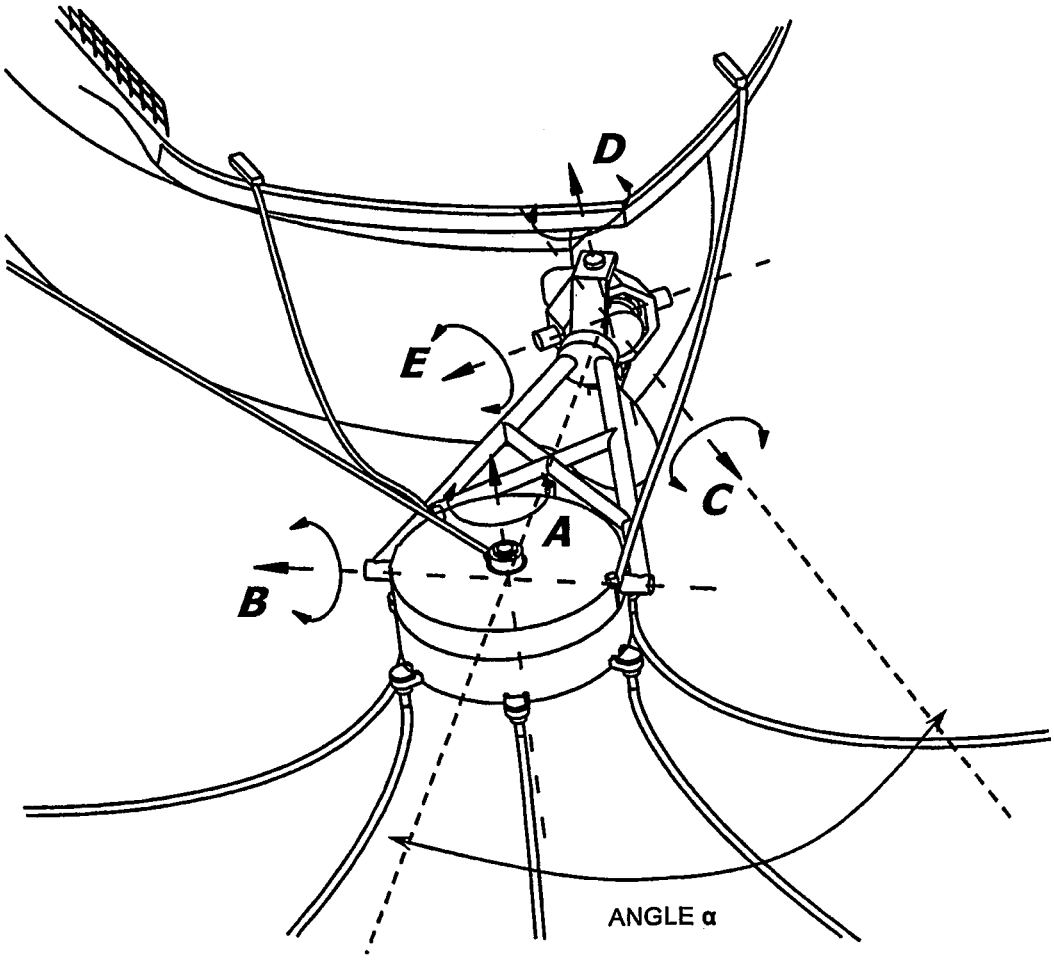

FIGS. 1A and 1B show a mooring system 100 in a mooring configuration according to one embodiment of the invention.

In the mooring configuration, a station keeping apparatus 110 comprises a single buoy 114 or a floatable device which provides buoyancy, for deep water applications. The single buoy 114 is secured at an offshore location using anchor legs 112 connecting the single buoy 114 to a sea bed. A turntable 116 is rotatably mounted on the buoy 114 to allow free rotational motion or one degree of freedom about a vertical centre line of the buoy 114 (see arrow A in FIG. 1B). In a mooring configuration, the turntable 116 would allow the moored vessels to weather vane about the station keeping apparatus 110. The direction and magnitude of weather vaning depend on the prevailing weather direction and forces acting on the vessels. Further, the turntable 116 is movably coupled to a first end of a rigid yoke 120 to allow relative pivotal motion or one additional degree of freedom about a horizontal centre line through the turntable 116 (see arrow B in FIG. 1B). For this purpose, a pivot or hinge connector 160 may be provided. At a second distal end of the rigid yoke 120, the rigid yoke 120 is movably coupled to a first vessel 10, either at a bow or a stern of the first vessel 10. For this purpose, a ball joint 162, e.g. a gimball assembly, may be provided. The ball joint 162 would allow rotational motions in three directions or additional three degrees of freedom (see arrows C, D and E in FIG. 1B). More particularly, the rotational motions provided by the ball joint 162 may be about a longitudinal or horizontal centre line the first vessel 10, a vertical line through the ball joint 162 and a horizontal line through the ball joint 162.

A vertical column 118 may be fixedly coupled to a centre of the single buoy 114. This may be achieved by providing a hole through a centre of the turntable 116 and disposing the vertical column 118 through the hole to be fixedly coupled to the buoy 114. The vertical column 118 provides a supporting structure for a mooring ring 130 which is rotatably mounted or fitted around the vertical column 118. The mooring ring 130, when fitted around the vertical column, is capable of rotational motion independent of the turntable 116. A quick release hook may be provided at the mooring ring 130 to act as a mooring point to which one end of a head mooring line 140 may be attached to. The quick release hook may allow instant release of the head mooring line 140 during emergency situations.

In a mooring configuration, a first end of a head mooring line 140 is secured to the mooring ring 130 and a second end of the head mooring line 140 is secured, via a fairlead 24, to a control winch 22 on the second vessel 20. The control winch 22 maintains an appropriate tension in the head mooring line 140 to dispose the first vessel 10 and the second vessel 20 in a side-by-side parallel arrangement. When changes in the vessels and/or weather induce a new equilibrium position which is misaligned with the prevailing weather direction, a length of the head mooring line 140 may be adjusted, such as through the control winch 22, to align a heading of both the first vessel 10 and the second vessel 20 with the prevailing weather direction. While adjusting the length of the head mooring line 140, an angular displacement between the station keeping apparatus 110 and a longitudinal centre line of the first vessel 10 is also adjusted at the same time.

An elastic line 150 may connect each bow or stern side of the first vessel 10 to each corresponding side of the turntable 116. The elastic line 150 is operable to prevent over-rotation of the rigid yoke 120 relative to the first vessel 10. In a mooring configuration, when an angular displacement between the station keeping apparatus 110 and a longitudinal centre line of the first vessel 10 (see angle $\alpha$ in FIG. 1B between a centre line of the rigid yoke 120 and a longitudinal centre line of the first vessel 10) exceeds a predetermined value such that the elastic lines 150 are stretched beyond their maximum lengths, a soft line stopper securing 152 each elastic line 150 to each bow side of the first vessel 10 is operable to gradually increase the tension force in each elastic line 150 to prevent over rotation of the rigid yoke 120 relative to the first vessel 10.

Figure 2A:
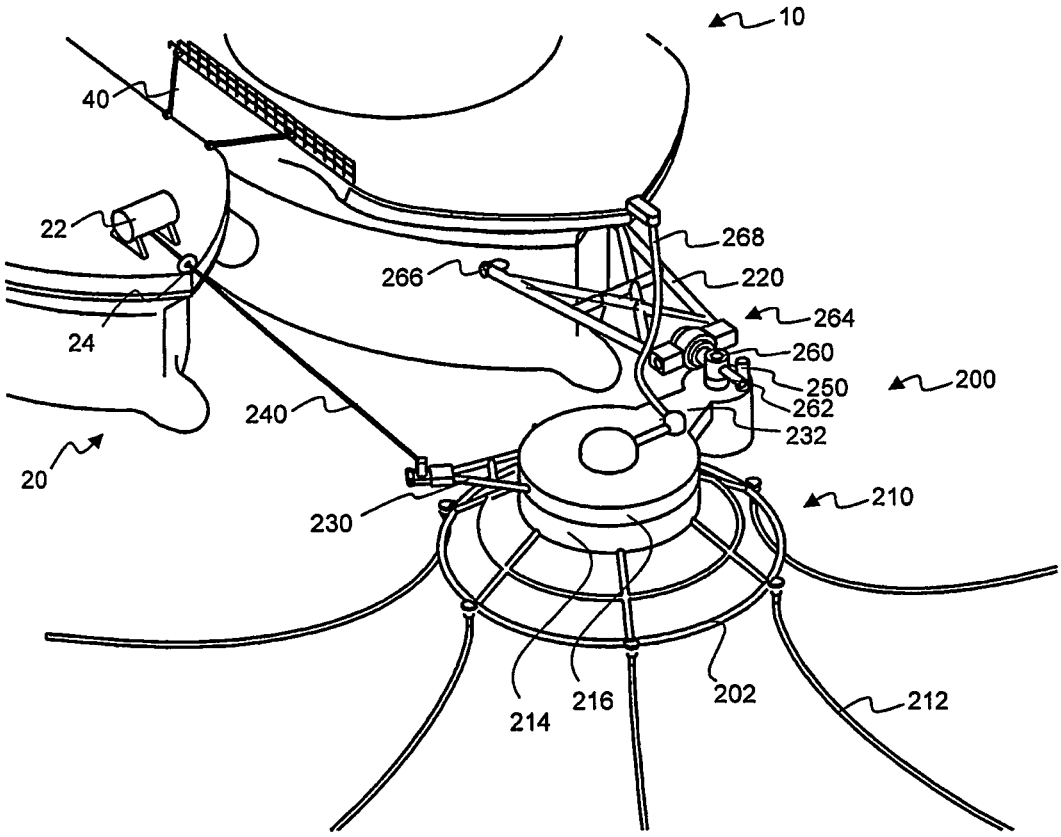
FIGS. 2A and 2B illustrate a mooring system in a mooring configuration according to one embodiment of the invention.
Figure 2B:
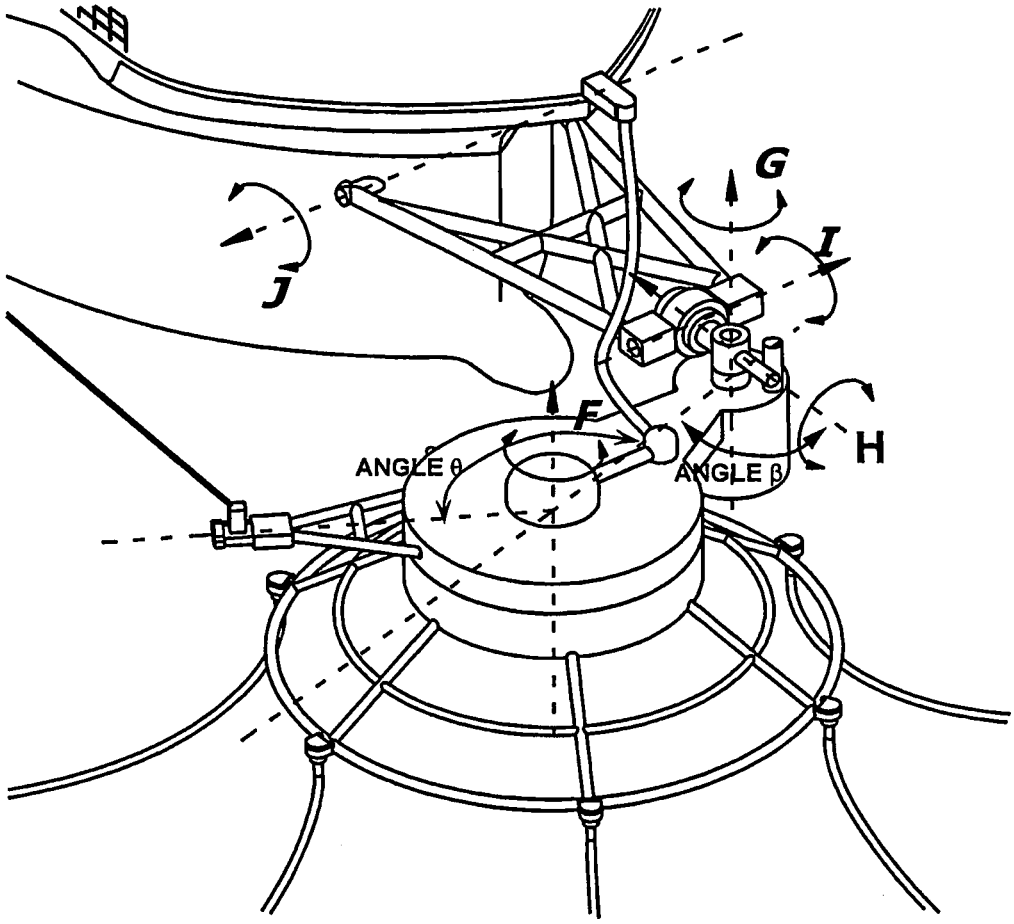

FIGS. 2A and 2B show a mooring system 200 in a mooring configuration according to another embodiment of the invention.

In the mooring configuration, a station keeping apparatus 210 comprises a single buoy 214 or floatable device and a truss structure 202 rigidly extending from a lower edge of the buoy 214, for deep water applications. The single buoy 214 is secured at an offshore location using anchor legs 212 connecting the single buoy 214 to a sea bed. The truss structure 202 has a larger diameter than the buoy 214 to provide stability to the station keeping apparatus 210.

A turntable 216 is rotatably mounted on the buoy 214 to allow free rotational motion or one degree of freedom about a vertical centre line of the buoy 214 (see arrow F in FIG. 2B). Two side arms, e.g. Y-arm 232 and M-arm 230, are fixedly coupled to the turntable 216. The Y-arm 232 or first side arm extends generally in the direction of a first vessel 10 while the M-arm 230 or second side arm extends generally in the direction of a second vessel 20. The Y-arm 232 and the M-arm 230 are suitably disposed relative to the turntable 216 such that the centre lines of the Y-arm 232 and the M-arm 230 form an angle therebetween (see angle $\theta$ in FIG. 2B). The angle $\theta$ depends on several factors including, but not limited to, vessel size, site condition and weather condition. Typically, the angle $\theta$ is other than 180 degrees.

The Y-arm 232 or first side arm has a first end rigidly extending from the turntable 216, and a second distal end movably coupled to a first end of a rigid yoke 220. More particularly, a first beam member 260 is vertically disposed at the second end of the Y-arm 232, and is constructed and arranged to receive therein a second beam member 262 of a universal joint 264. Coupling of the first beam member 260 and the second beam member 262 of the universal joint 264 allows rotational motion or one degree of freedom about a vertical axis through a centre of the first beam member 260 (see arrow G in FIG. 2B). The universal joint 264 would further allow rotational motions in two directions or two additional degrees of motion (see arrows H and I). More particularly, the rotational motions provided by the universal joint 264 may be about a longitudinal or horizontal centre line through the first vessel 10, a vertical line through the first beam 260 and a horizontal axis through the second beam 262.

An anti-rotation stop member 250 may be suitably disposed on the Y-arm 232 to prevent over-rotation of the rigid yoke 220 relative to the Y-arm 232 or first side arm in any rotation direction. More particularly, an anti-rotation stop member 250 may be arranged on the Y-arm 232 such that the anti-rotation stop member 250 is operable to meet with the second beam 262 when an angular displacement between the station keeping apparatus 210 and a longitudinal or horizontal centre line of the first vessel 10 (see an angle $\beta$ in FIG. 2B between a centre line of the Y-arm 232 and a longitudinal centre line of the rigid yoke 220 or the first vessel 10) exceeds a predetermined value.

The second distal end of the rigid yoke 220 is movably coupled to the first vessel 10 to allow pivotal motion or one additional freedom of motion (see arrow J in FIG. 2B). For this purpose, a hinge or pivot connector 266 may be provided.

The M-arm 230 or second side arm has a first end rigidly extending from the turntable 216 and a second distal free end generally extending towards the second vessel 20. An attachment point may be provided on the M-arm 230 from which a head mooring line 240 may be attached to in order to connect the second vessel 20 to the mooring system. The attachment point may provide a quick release hook for instant release of the head mooring line 240. If required, a flexible hose 268 may be provided connecting the turntable 216 to the first vessel 10 for transferring fluids from the seabed or other sources to the first vessel 10.

In a mooring configuration, a first end of a head mooring line 240 is secured to the M-arm 230 and a second end of the head mooring line 240 is secured, via a fairlead 24, to a control winch 22 on the second vessel 20. The control winch 22 maintains an appropriate tension in the head mooring line 240 to dispose the first vessel 10 and the second vessel 20 in a side-by-side parallel arrangement. When changes in the vessels and/or weather induce a new equilibrium, position which is misaligned with the prevailing weather direction, a length of the head mooring line 240 may be adjusted, such as through the control winch 22, to align a heading of both the first vessel 10 and the second vessel 20 with the prevailing weather direction. While adjusting the length of the head mooring line 240, an angular displacement between the station keeping apparatus 110 and a longitudinal centre line of the first vessel 10 is also adjusted at the same time.

In both embodiments illustrated by FIGS. 1A to 1B and 2A to 2B, a control winch 22 and a fairlead 24 are provided on the second vessel 20. A head mooring line connecting from the station keeping apparatus is passed through the fairlead 24 and secured to the control winch 22. Using the control winch 22, a length of the head mooring line can be adjusted which, in turn, adjusts a heading of the two vessels 10, 20 to align with the prevailing weather direction when weather conditions and/or relative displacement between vessels 10, 20 are changed.

Figure 5:
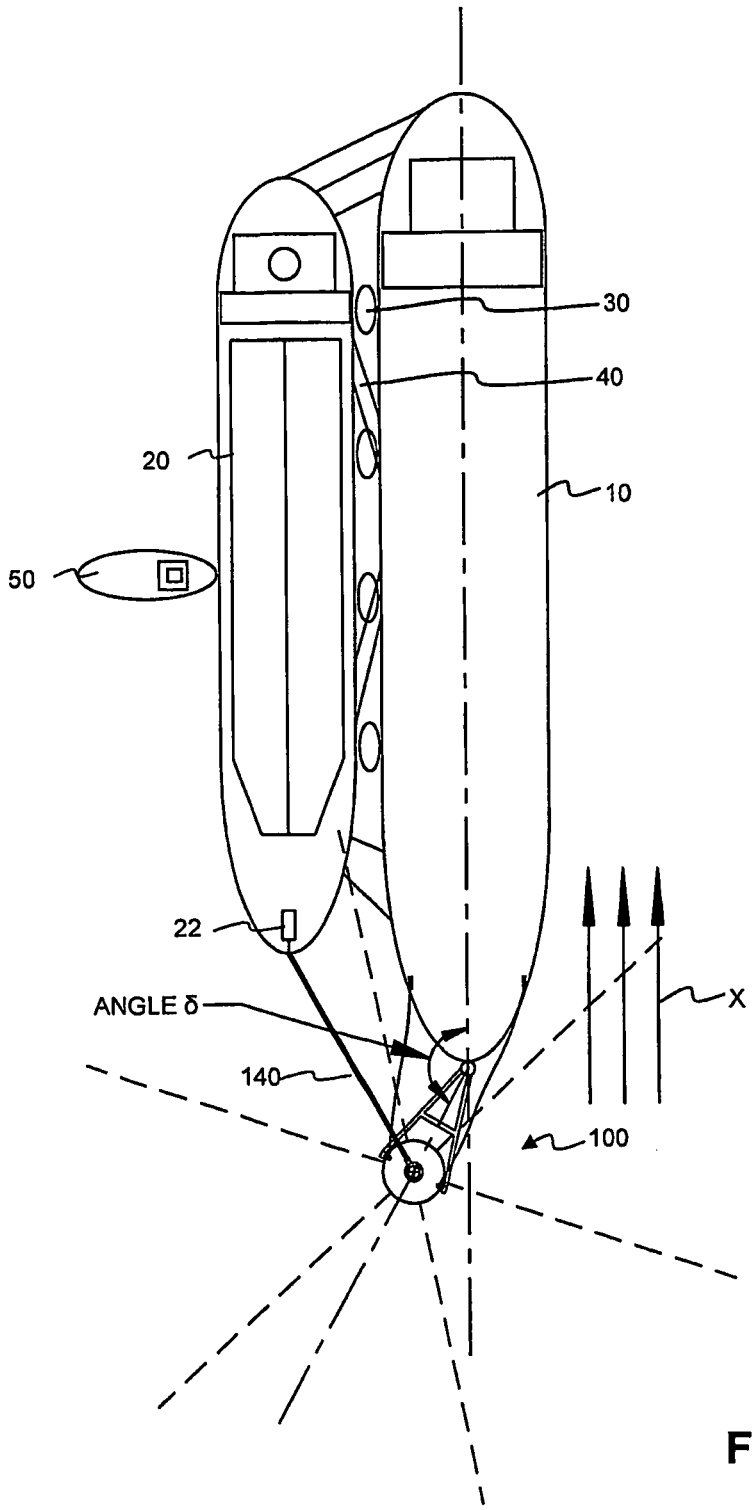
FIG. 5 illustrates a mooring configuration of two vessels according to one embodiment of the invention.

Fenders 30 may be arranged between the first vessel 10 and the second vessel 20 for maintaining separation therebetween to prevent damage caused by relative movement of the vessels 10, 20. Side-by-side mooring lines 40 may also be arranged to connect adjacent sides of the two vessels. In particular, breasting mooring lines may be used in bows and sterns of the two vessels; spring mooring lines may also be used between the two vessels. FIG. 5 illustrates an overall layout of fenders and side-by-side mooring lines.

In the present description, the first vessel 10 or mother vessel may be a Floating Production, Storage and Offloading (FPSO) vessel, Floating Production Unit (FPU), Floating Storage and Offloading vessel, offshore floating gas terminal, or other floating structures. The second vessel 20 may be a shuttle carrier vessel or other marine vessel. However, it is to be appreciated that embodiments of the invention are equally applicable to other types of vessels or structures with suitable modifications.

In the drawings and present description, references are made to coupling the bows of the first vessel 10 and the second vessel 20 to the station keeping apparatus of the mooring system. It is to be appreciated that the sterns of the first vessel 10 and the second vessel 20 may be coupled or moored to the station keeping apparatus of the mooring system.

Figure 6A:
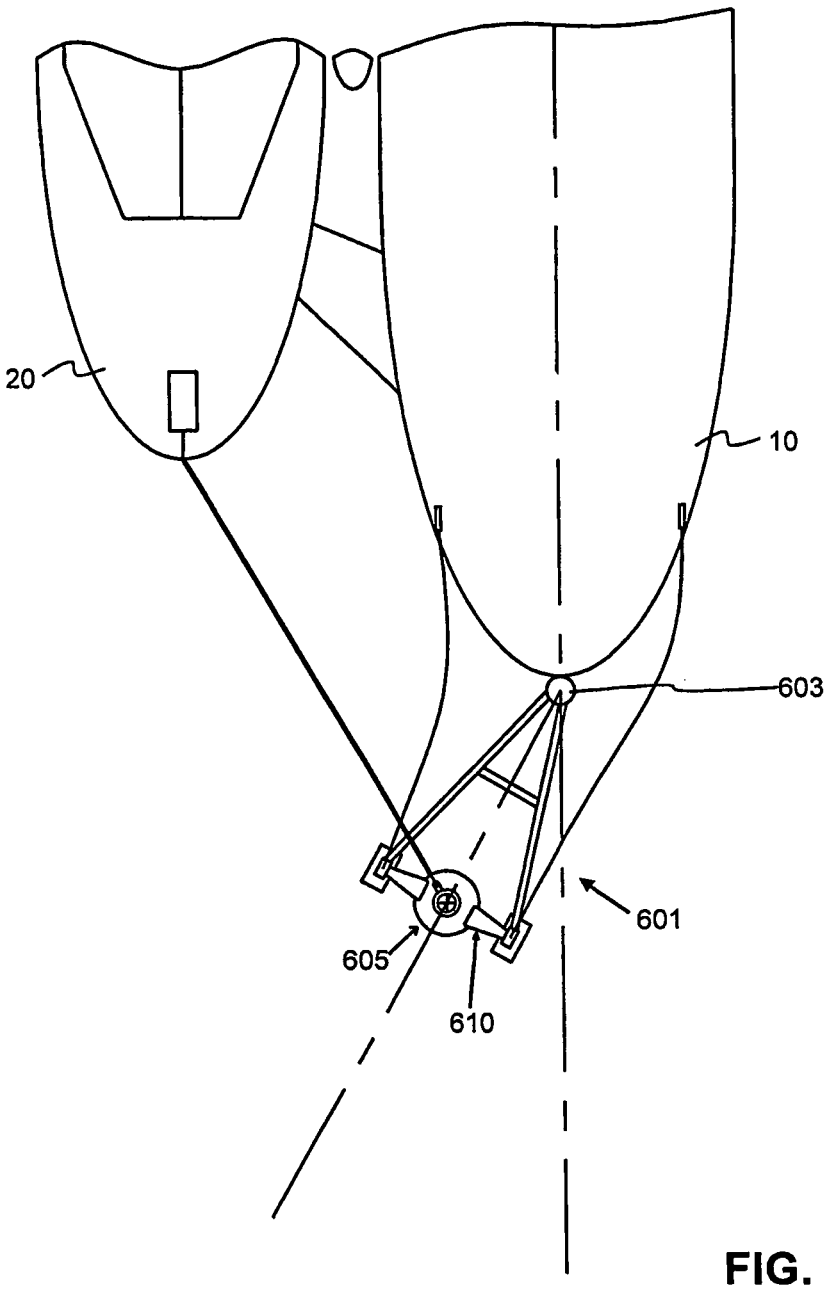
FIG. 6A illustrates a mooring system in a mooring configuration according to one embodiment of the invention.
Figure 6B:
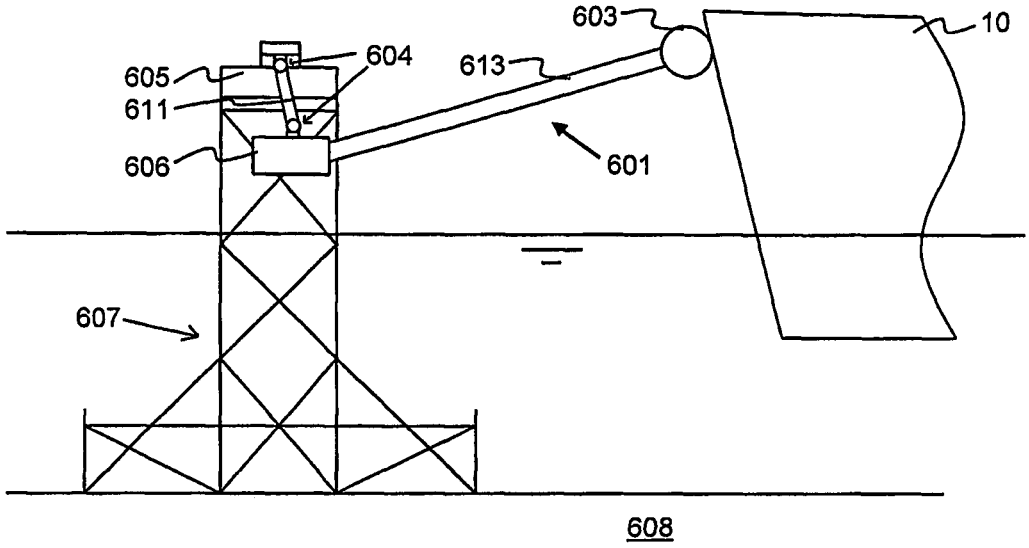
FIG. 6B is a side view of FIG. 6A.

The mooring system of FIGS. 1A and 1B, and FIGS. 2A and 2B may be suitably modified for shallow water applications. Reference is made to FIGS. 6A and 6B illustrating a mooring system according to one embodiment of the invention. The mooring system of FIGS. 6A and 6B has some similarities to the mooring system of FIGS. 1A and 1B. However, suitable modifications may include, but are not limited to, replacing the buoy of the station keeping apparatus with a fixed structure or tower founded on a sea bed; rotatably mounting the turntable on the fixed structure; and replacing the rigid yoke by a soft yoke.

As shown in FIGS. 6A and 6B, a mooring system may comprise a station keeping apparatus which includes a fixed structure 607 founded on a sea bed 608. The station keeping apparatus further includes a turntable 605 rotatably mounted on the fixed structure 607. The station keeping apparatus is operable to movably couple to a first vessel 10 and to a second vessel 20 for providing a side-by-side mooring configuration, and the turntable 607 is operable to freely rotate both the first vessel 10 and the second vessel 20 about the station keeping apparatus. Further, the station keeping apparatus is securable to the second vessel 20 using a head mooring line having a length which is adjustable for aligning a heading of both the first vessel 10 and the second vessel 20 with a prevailing weather direction. Further, the mooring system may further comprise a soft yoke 601 movably coupling the turntable 605 to the first vessel 10 for providing adjustable angular displacement between the station keeping apparatus and a longitudinal centre line of the first vessel 10.

The soft yoke 601 movably couples the turntable 605 to the first vessel 10. For this purpose, side arms 610 may rigidly extend from the turntable 605 to movably couple to the soft yoke 601. More particularly, the side arms 610 are movably coupled, e.g. by a universal joint 604, to a hanging beam 611. A lower end of the hanging beam 611 may be movably coupled, e.g. by a universal joint 604, to a counter weight 606. A first end of a soft yoke arm 613 may be fixedly coupled to the counter weight 606, while a second distal end of the soft yoke arm 613 is movably coupled, e.g. by a ball joint 603, to a first vessel 10. A vertical column may be fixedly coupled to the fixed structure 607 to provide a supporting structure for a mooring ring which is rotatably mounted or fitted around the vertical column. The mooring ring, when fitted around the vertical column, is capable of rotational motion independent of the turntable 605.

In the following paragraphs, berthing, offloading and unberthing operations are described with reference to the embodiment of FIGS. 1A and 1B. It is to be appreciated that the described operations are applicable to the embodiments of FIGS. 2A and 2B, and FIGS. 6A and 6B with suitable modifications.

Berthing Two Vessels

Figure 3:
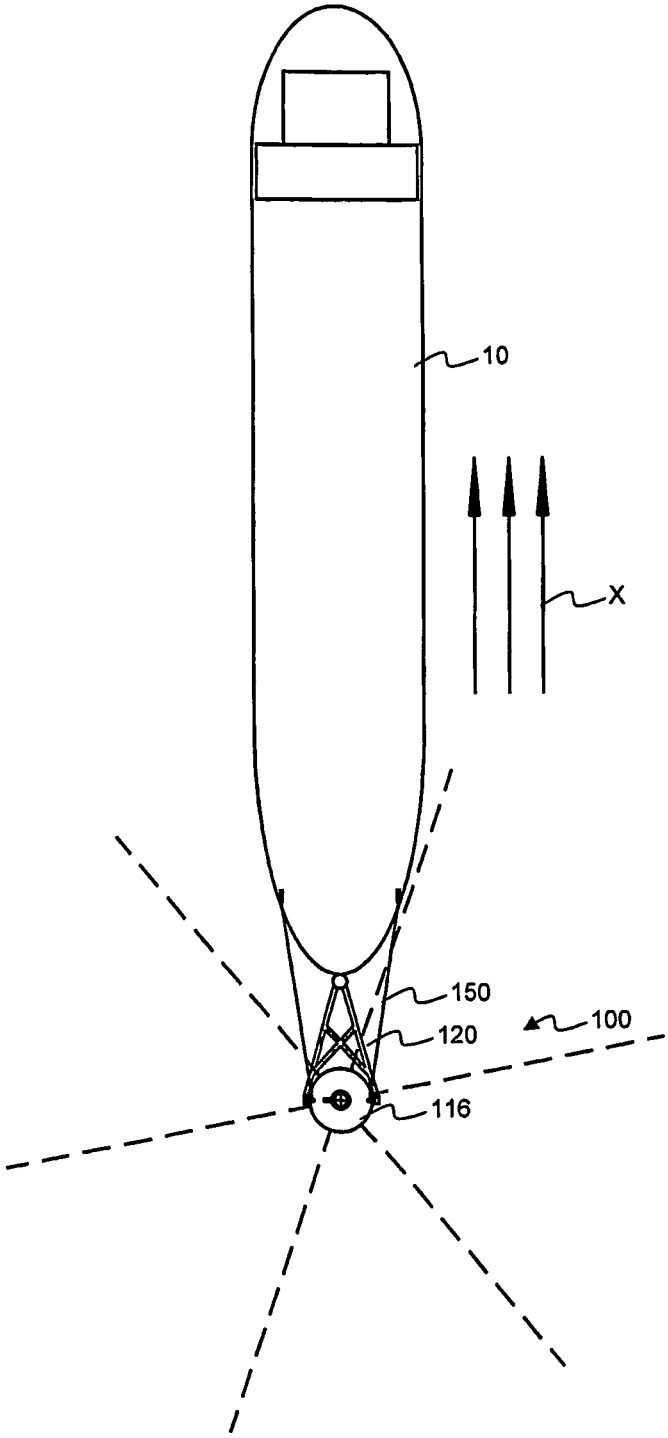
FIG. 3 illustrates a first vessel moored to a station keeping apparatus.

Before a berthing operation, a first vessel 10 is single-point moored to a station keeping apparatus 110 (see FIG. 3). More particularly, the first vessel 10 is movably coupled to a turntable of the station keeping apparatus 110 by a rigid yoke. The method proceeds to securing anti-over rotation lines or elastic lines between the first vessel 10 and the turntable to prevent over rotation of the rigid yoke relative to the first vessel 10. As shown in FIG. 3, the elastic lines are in a resting position in which the elastic lines are not stretched. When the first vessel 10 is appropriately moored to the station keeping apparatus 110, the heading of the first vessel 10 may be self-adjusted or weather vaned in response to changes in the prevailing weather direction by free rotation of the first vessel 10 around the station keeping apparatus 110. FIG. 3 illustrates a prevailing weather direction denoted by arrows X and the heading of the first vessel 10 aligned to the prevailing weather direction.

Figure 4:
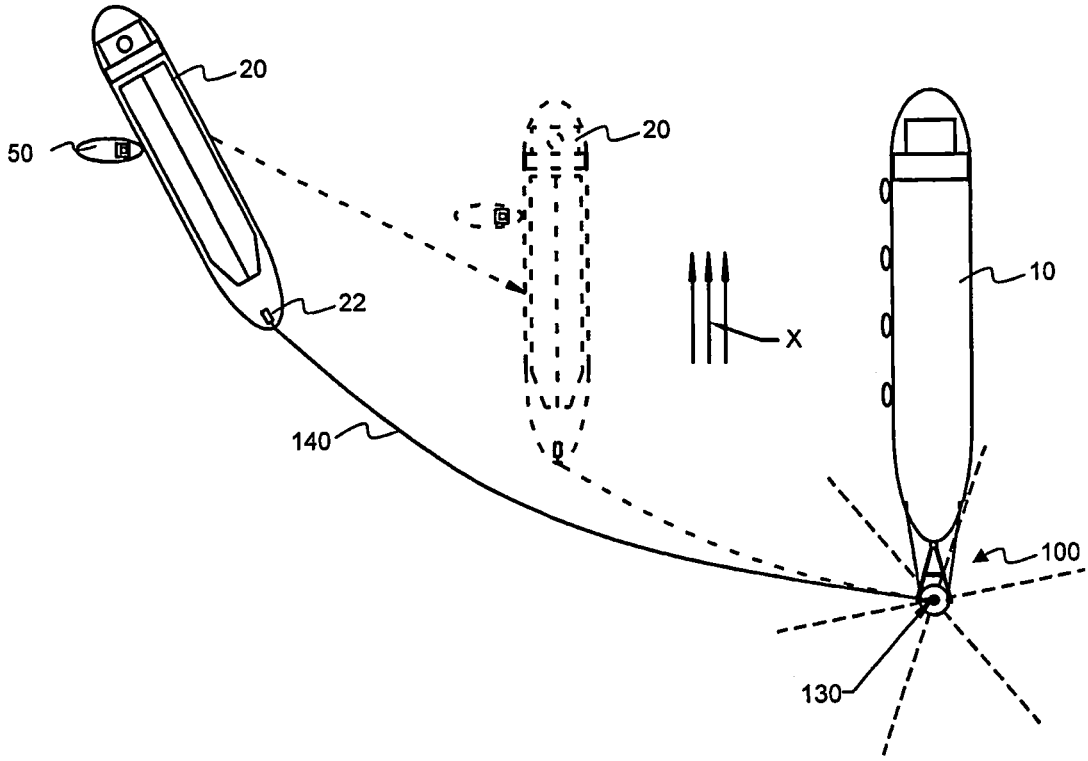
FIG. 4 illustrates a process for mooring a second vessel to a first vessel according to one embodiment of the invention.

Reference is made to FIG. 4 to illustrate a berthing operation of two vessels. Berthing of the two vessels may proceed under benign weather conditions at field site. A head mooring line 140 may have a first end secured to the station keeping apparatus 110, more particularly to a quick release hook at a mooring ring of FIGS. 1A and 1B (or to a second side arm of the embodiment in FIGS. 2A and 2B, or to a mooring ring of the embodiment in FIGS. 6A and 6B). A distal free end or second end of the head mooring line 140 may be guided by a tug 50. The tug 50 may be generally located at a safe distance from the first vessel 10 and appropriately oriented to receive an approaching second vessel 20.

When the second vessel 20 approaches the first vessel 10, the tug 50 approaches the second vessel 20 to secure a free end of the head mooring line 140 to a control winch on the second vessel 20 through a fairlead, thereby securing the second vessel 20 to the station keeping apparatus 110 using the head mooring line 140. After the head mooring line 140 is secured to second vessel 20, the main engine of the second vessel 20 may be powered down. The tug 50 may then push a starboard side of the second vessel 20 towards the first vessel 10 while a control winch 22 on the second vessel 20 is simultaneously operable to pull the bow of the second vessel 20 towards the first vessel 10.

The angle of approach adopted by the second vessel 20 should not be excessive, i.e. the second vessel 20 should not approach the first vessel 10 in a substantially transverse or head-on direction. One method of berthing involves the second vessel 20 approaching the first vessel 10, which has a constant heading, from the quarter on the side of berthing. On closer approach, the second vessel 20 should parallel the course of first vessel 10 at a safe distance that is appropriate under the weather and site conditions, before positioning itself relative to first vessel 10. This process is illustrated in FIG. 4.

A distance between the first vessel 10 and the second vessel 20 is reduced by pushing of the tug 50 and pulling of the head mooring line 140 by the controlling winch until fenders 30 come into contact with the second vessel 20. This way, the head mooring line 140 is tensioned for disposing the first vessel 10 and the second vessel 20 in a side-by-side arrangement, where the first vessel 10 and the second vessel 20 may be substantially parallel to each other.

After the second vessel 20 comes into contact with the fenders 30, side-by-side mooring lines 40, e.g. breasting mooring lines and spring mooring lines, may also be arranged to connect adjacent sides of the two vessels.

When all head and side-by-side mooring lines are secured and tightened at a desired tension, a heading of both the first vessel 10 and the second vessel 20, as a single system, may not be aligned with the prevailing weather direction. Consequently, a length of the head mooring line 140 secured between the station keeping apparatus 110 and the second vessel 20 may be adjusted for aligning a heading of both the first vessel 10 and the second vessel 20 with the prevailing weather direction. More particularly, the tug 50 may continue to push the starboard side of the second vessel 20 while the control winch of the second vessel 20 continues to pull the head mooring line 140. The tug 50 and control winch 22 are operable to adjust or rotate a centre line of the rigid yoke or turntable to form an angle δ with a longitudinal centre line of the first vessel 10 such that the heading of the first vessel 10 and the second vessel 20, as a single system, is aligned to the prevailing weather direction. FIG. 5 illustrates a side-by-side mooring configuration in which a heading of both the first vessel 10 and the second vessel 20 is aligned with the prevailing weather direction.

Offloading Operation

After the first vessel 10 and the second vessel 20 are arranged in a side-by-side mooring configuration, offloading operations may be performed. During offloading from the first vessel 10 to a second vessel 20, displacement of the first vessel 10 is decreased gradually while displacement for the second vessel 20 is increased gradually. Due to the changes in relative height displacement of the vessels, environmental induced forces in the hulls of the first vessel 10 and the second vessel 20 are also changed accordingly. This causes the second vessel 20 to push the first vessel 10, such that both the first vessel 10 and the second vessel 20 rotate about the centre of the station keeping apparatus 110 to take on a new equilibrium position. With the new equilibrium position, a heading of both the first vessel 10 and the second vessel 20 is misaligned with the prevailing weather direction.

In order to re-align a heading of both the first vessel 10 and the second vessel 20 with the prevailing weather direction, the length of the head mooring line 140 secured between the station keeping apparatus 110 and the second vessel 20 is adjusted for re-aligning the heading of both the first vessel 10 and the second vessel 20 with the prevailing weather direction. More particularly, the control winch 22 on the second vessel 20 is operable to pull the head mooring line 140 to reduce the angle δ to an appropriate value. Positioning a heading of both the first vessel 10 and the second vessel 20 in line with the prevailing weather direction would significantly reduce relative motions between the first vessel 10 and the second vessel 20 which, in turn, would increase efficiency of side-by-side offloading operations between the two vessels.

Further, if the prevailing weather condition changes such that the heading of the first vessel 10 and the second vessel 20 become misaligned or unparallel to the prevailing weather direction, the above-described operation of adjusting the length of the head mooring line 140 secured between the station keeping apparatus 110 and the second vessel 20 for re-aligning the heading of both the first vessel 10 and the second vessel 20 with the prevailing weather direction may be performed.

Un-Berthing Two Vessels

After an offloading operation, the second vessel 20 may leave the first vessel 10. To this purpose, a tug 50 may approach a starboard side of the second vessel 20. A towing line may connect the bow of tug 50 and a mooring point on the starboard of shuttle carrier, for pulling the second vessel 20 away from the first vessel 10. The breasting mooring lines and spring mooring lines may be disconnected in sequence, but the head mooring line 140 may remain connected. After the breasting mooring lines and spring mooring lines are disconnected, the engine of the tug 50 may be powered on for operation. The control winch of the second vessel 20 gradually releases tension in the head mooring line 140, and releases some control of the heading of the second vessel 20. When the second vessel 20 is pulled to a safe distance from the first vessel 10, the head mooring line 140 and towing line from the tug 50 may be disconnected. The tug 50 may also be navigated away from the second vessel 20. After the tug 50 moves to a safe distance from the second vessel 20, main engine of the second vessel 20 can be powered on and navigated towards its next destination.

Other embodiments will be apparent to those skilled in the art from consideration of the specification and practice of the invention. Furthermore, certain terminology has been used for the purposes of descriptive clarity, and not to limit the disclosed embodiments of the invention. The embodiments and features described above should be considered exemplary, with the invention being defined by the appended claims.

The invention claimed is:

1. A mooring system comprising:

a station keeping apparatus which includes a turntable rotatably mounted thereon, wherein the turntable is operable to movably couple to a first vessel to provide the first vessel with one rotational freedom about a vertical axis relatively to the turntable, and wherein the station keeping apparatus is operable to dispose the first vessel and a second vessel in a side-by-side mooring configuration by movably coupling to the second vessel using a head mooring line such that when a heading of both the first vessel and the second vessel is caused to take on a new equilibrium position which is misaligned with a prevailing weather direction, a length of the head mooring line secured between the second vessel and the station keeping apparatus is adjustable to adjust an angular displacement between the station keeping apparatus and a longitudinal center line of the first vessel to align the heading of both the first vessel and the second vessel with the prevailing weather direction.

2. The mooring system of claim 1, wherein the second vessel is caused to take on the new equilibrium position due to one of a change in relative displacement between the first vessel and the second vessel, and a change in a prevailing weather condition.

3. The mooring system of claim 2, further comprising: one of a rigid yoke and a soft yoke movably coupling the turntable to the first vessel for providing adjustable angular displacement between the station keeping apparatus and a longitudinal center line of the first vessel.

4. The mooring system of claim 1, wherein the station keeping apparatus is operable to movably couple to one of a bow and a stern of the first vessel, and to one of a bow and a stern of the second vessel for providing the side-by-side mooring configuration.

5. A method for side-by-side mooring, the method comprising:

mooring a first vessel to a station keeping apparatus;

securing a second vessel to the station keeping apparatus using a head mooring line;

tensioning the head mooring line for disposing the first vessel and the second vessel in a side-by-side arrangement; and when a heading of both the first vessel and the second vessel is caused to take on a new equilibrium position which is misaligned with a prevailing weather direction, adjusting a length of the head mooring line secured between the second vessel and the station keeping apparatus to adjust an angular displacement between the station keeping apparatus and a longitudinal center line of the first vessel to align the heading of both the first vessel and the second vessel with the prevailing weather direction.

6. The method of claim 5, wherein the second vessel is caused to take on the new equilibrium position due to one of a change in relative displacement between the first vessel and the second vessel, and a change in a prevailing weather condition.

7. The method of claim 5, wherein adjusting a length of the head mooring line further includes adjusting a control winch which secures one end of the head mooring line to the second vessel.

8. The method of claim 5, wherein mooring a first vessel to a station keeping apparatus further includes mooring one of a bow and a stern of the first vessel to the station keeping apparatus, and wherein securing a second vessel to the station keeping apparatus using a head mooring line further includes securing one of a bow and a stern of the second vessel to the station keeping apparatus.

9. A mooring system comprising:

a station keeping apparatus which includes a turntable rotatably mounted thereon, wherein the turntable is operable to movably couple to a first vessel to provide the first vessel with one rotational freedom about a vertical axis relatively to the turntable, wherein the station keeping apparatus is operable to dispose the first vessel and a second vessel in a side-by-side mooring configuration by movably coupling to the second vessel using a head mooring line having a length which, in response to a misalignment of a heading of both the first vessel and the second vessel with a prevailing weather direction, is adjustable to align the heading of both the first vessel and the second vessel with the prevailing weather direction, and wherein the station keeping apparatus further includes:

a buoy upon which the turntable is rotatably mounted, wherein the buoy is secured to a sea bed using a plurality of anchor legs; and a ring rotatably mounted on the buoy, wherein the ring is operable to rotate independently of the turntable and to secure a first end of the head mooring line.

10. The mooring system of claim 9, further comprising a rigid yoke having a first end movably coupled to the turntable and a second distal end operable to movably couple to the first vessel.

11. The mooring system of claim 9, wherein a second distal end of the head mooring line is securable to a control winch on the second vessel, and the control winch is operable to adjust the length of the head mooring line.

12. The mooring system of claim 9, wherein the turntable is further operable to couple to the first vessel using a plurality of elastic lines and a plurality of line stoppers, the plurality of elastic lines and the plurality of line stoppers are operable to prevent an angle between a center line of the rigid yoke and a longitudinal center line of the first vessel from exceeding a predetermined value.

13. The mooring system of claim 9, further comprising:

a pivot joint pivotally coupling the turntable to the first end of the rigid yoke; and a ball joint for movably coupling the second end of the rigid yoke to the first vessel, wherein the pivot joint and the ball joint are operable to provide four degrees of freedom.

14. A mooring system comprising:

a station keeping apparatus which includes a turntable rotatably mounted thereon, wherein the turntable is operable to movably couple to a first vessel to provide the first vessel with one rotational freedom about a vertical axis relatively to the turntable, wherein the station keeping apparatus is operable to dispose the first vessel and a second vessel in a side-by-side mooring configuration by movably coupling to the second vessel using a head mooring line having a length which, in response to a misalignment of a heading of both the first vessel and the second vessel with a prevailing weather direction, is adjustable to align the heading of both the first vessel and the second vessel with the prevailing weather direction, and wherein the station keeping apparatus further includes a buoy upon which the turntable is rotatably mounted, wherein the buoy is secured to a sea bed using a plurality of anchor legs;

a first side arm rigidly extending from the turntable;

a second side arm rigidly extending from the turntable, wherein an angular displacement between the first side arm and the second side arm is other than 180 degrees, and the second side arm is operable to secure a first end of the head mooring line; and a rigid yoke having a first end movably coupled to the first side arm and a second distal end operable to movably couple to the first vessel.

15. The mooring system of claim 14, wherein a second distal end of the head mooring line is securable to a control winch on the second vessel, and the control winch is operable to adjust the length of the head mooring line.

16. The mooring system of claim 14, further comprising: a stop member disposed on the first side arm, wherein the stop member is operable to prevent an angle between a center line of the rigid yoke and a longitudinal center line of the first vessel from exceeding a predetermined value.

17. The mooring system of claim 14, further comprising:

a beam member extending from the first side arm;

a universal joint movably coupling the beam member to the first end of the rigid yoke, wherein universal joint and the beam member are operable to provide three degrees of freedom; and a pivot joint for pivotally coupling the second end of the rigid yoke to the first vessel.

18. A mooring system comprising:

a station keeping apparatus which includes a turntable rotatably mounted thereon, wherein the turntable is operable to movably couple to a first vessel to provide the first vessel with one rotational freedom about a vertical axis relatively to the turntable, wherein the station keeping apparatus is operable to dispose the first vessel and a second vessel in a side-by-side mooring configuration by movably coupling to the second vessel using a head mooring line having a length which, in response to a misalignment of a heading of both the first vessel and the second vessel with a prevailing weather direction, is adjustable to align the heading of both the first vessel and the second vessel with the prevailing weather direction, and wherein the station keeping apparatus includes a fixed structure founded on a sea bed;

a ring rotatably mounted on the fixed structure, wherein the ring is operable to rotate independently of the turntable and to secure a first end of the head mooring line; and a soft yoke arm movably coupling the turntable to the first vessel.

19. The mooring system of claim 18, wherein the station keeping apparatus further includes a plurality of side arms extending from the turntable, each of the plurality of side arms movably coupled to a hanging beam which is movably coupled to a counter weight which is fixedly coupled to the soft yoke arm, wherein the soft yoke arm is movably coupled to the first vessel.

20. The mooring system of claim 18, further comprising:

a plurality of universal joints movably coupling the each of the plurality of side arms to the hanging beam, and movably coupling the hanging beam to the counter weight; and a ball joint movably coupling the soft yoke arm to the first vessel.

* * * * *